United States Patent [19]

Hanna

[11] Patent Number: 4,479,317

[45] Date of Patent: Oct. 30, 1984

[54] ELECTRICAL CIRCUIT MARKING IDENTIFICATION PLATE

[76] Inventor: Ivan E. Hanna, 2538 E. Third St., Tucson, Ariz. 85716

[21] Appl. No.: 424,529

[22] Filed: Sep. 27, 1982

[51] Int. Cl.[3] ..... A44C 3/00; G09F 3/18

[52] U.S. Cl. ..... 40/2 R; 40/10 R; 40/10 D; 179/66

[58] Field of Search ..... 174/66; 40/2 R, 10 R, 40/10 D

[56] References Cited

U.S. PATENT DOCUMENTS

| | | | |
|---|---|---|---|
| 2,515,820 | 7/1950 | Clark | 174/66 |
| 2,625,759 | 1/1953 | Koepke | 174/66 |
| 4,282,591 | 8/1981 | Andreuccetti | 174/66 |

FOREIGN PATENT DOCUMENTS

| | | | |
|---|---|---|---|
| 968882 | 6/1975 | Canada | 174/66 |
| 3026243 | 4/1982 | Fed. Rep. of Germany | 174/66 |
| 1340066 | 12/1973 | United Kingdom | 174/66 |
| 1423979 | 2/1976 | United Kingdom | 174/66 |
| 1588134 | 4/1981 | United Kingdom | 174/66 |

*Primary Examiner*—Gene Mancene
*Assistant Examiner*—James Hakomaki
*Attorney, Agent, or Firm*—J. Michael McClanahan

[57] ABSTRACT

An electrical circuit making identification plate is comprised of a transparent plastic material and is adapted to identify residential and industrial wiring circuits at the site of an electrical wall outlet box, by placement upon an electrical wall outlet box, between the electrical wall outlet box and the base plate of electrical receptacles in the outlet box. The flat transparent plate has an opening therein. The opening permits protrusion of electrical devices from an associated electrical wall box outlet to an electrical wall outlet box face cover plate. The flat transparent plate has notched openings which permit passage of screws from the receptacle base plate to the electrical wall outlet box. The transparent plate is held in place by tangs located on the associated electrical wall outlet box, and has adhesive attached thereto adapted to receive and secure an electrical circuit identification label.

7 Claims, 4 Drawing Figures

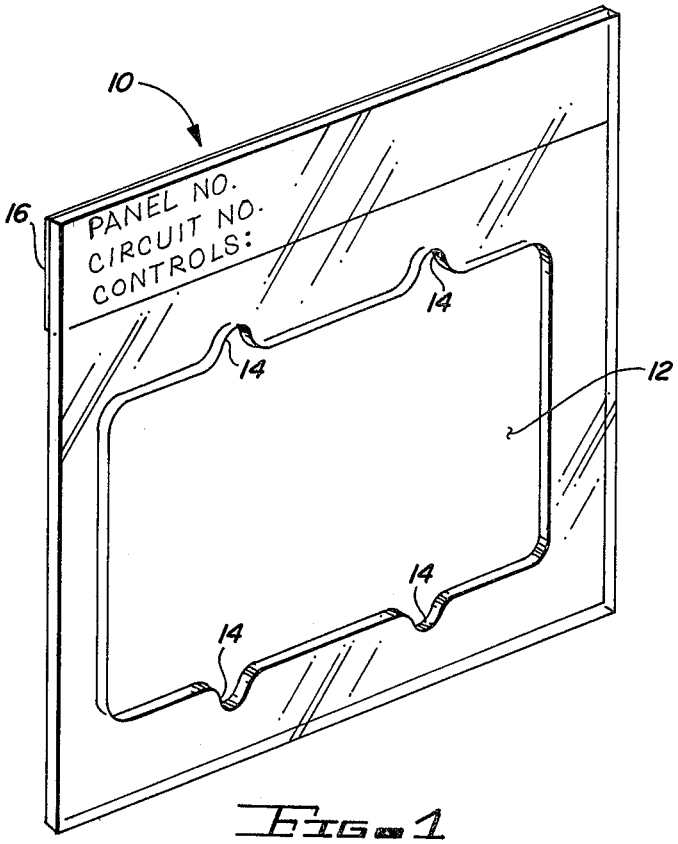
FIG. 1
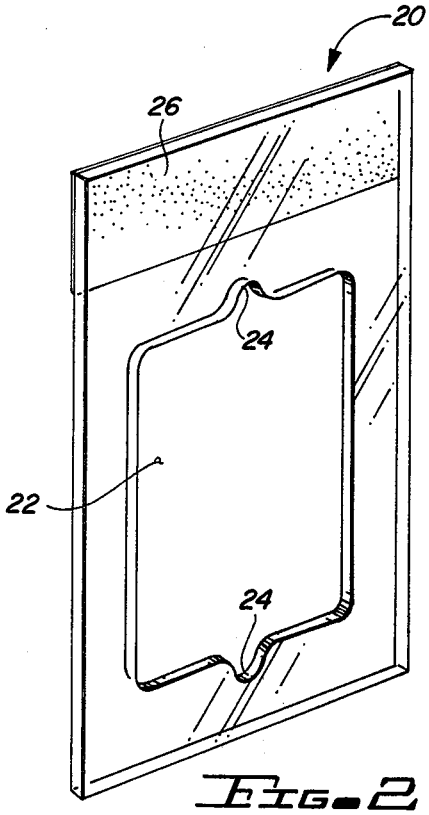
FIG. 2
FIG. 3
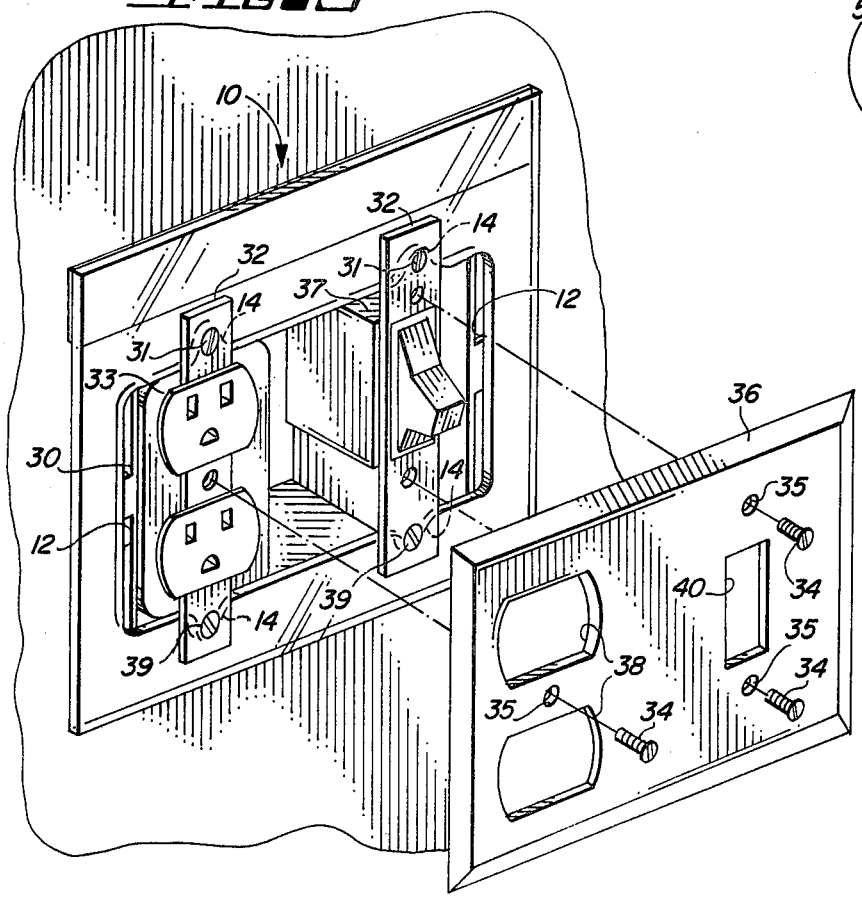
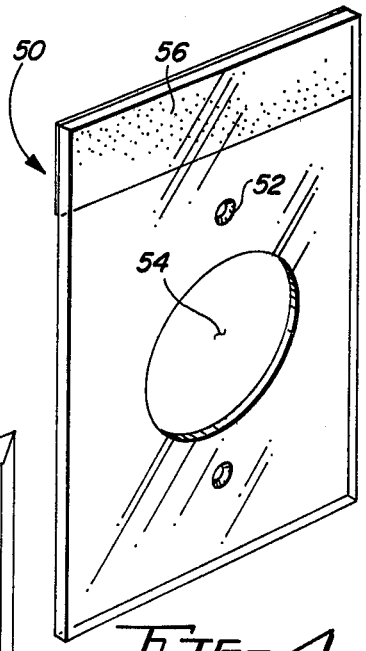
FIG. 4

ELECTRICAL CIRCUIT MARKING IDENTIFICATION PLATE

BACKGROUND OF THE INVENTION

In many industrial buildings it is a requirement for the plant engineer and maintenance group to know and be able to identify the correct electrical circuits in the various portions of the building complex. This means that an electrical circuit on a corridor wall, or in one of the offices or compartments in the building must be identified as to its location on the master electrical power control panel, as well as knowing the particular route by which the electrical wires communicate from the circuit breakers of the control panel and master control switches, to the particular wall outlet. This is particularly important for diagnosing electrical problems and for the correction of problems.

In the past, it is common for the engineer to attempt to identify a particular outlet or circuit by pouring over voluminous electrical schematic drawings, individually tracing the lines on the drawings from the electrical outlet back to the panel, and then hopefully making a notation of the route and circuit numbers so that if trouble should erupt on that particular circuit, it may be easily traced again.

In any event, unless a person's predecessors have been especially diligent to make these notations regarding the connection of a particular wall outlet and the particular circuit numbers, controls, panel numbers and the like, it can present a tedious and time consuming chore for the engineer at a time when most inconvenient.

Now it is common in the industrial wiring to identify power control boxes, circuit wiring runs and controls, however, even with the best notation on the drawings, it still necessitates that should a problem arise at an electrical wall outlet, reference must be made to the master drawing. In doing so, of course much time is consumed.

It is to the expedient use of identifying the source and particular path used by electrical wiring to the electrical wall outlet to which the subject invention is directed.

SUMMARY OF THE INVENTION

The subject invention relates to a means of identification of electrical wall outlet circuits, panel numbers, and controls at the site of the electrical outlet which are readily visible, but which are not easily removed, covered, or mutilated.

The subject invention comprises a transparent plastic plate adapted to be placed intermediate the electrical wall outlet box and the electrical receptacle or switch base plate, which is in turn covered by the face cover plate, the transparent plastic plate having at least one opening therethrough for the electrical apparatus to protrude, and in addition, means are provided by which an electrical identification circuit label may be affixed in a permanent and protected manner so that it remains always visible. To do so, the plate exceeds in dimension the perimeter of the wall outlet face cover plate a short distance on three of the four sides, and on the fourth side protrudes a sufficient distance for the circuit identification label to be affixed to the underside of the transparent plate for observation thereof.

The transparent plate, in addition to having a generally central located opening for the electrical apparatus to communicate through, provides notch means as a part of the opening to permit the screws fastening the receptacle base plate to the electrical wall outlet box to be replaced. The transparent plate is held in place by resting upon the tangs of the electrical wall outlet box which have the threaded holes therein to receive the screws holding the subject invention and the particular electrical receptable or switch or other electrical apparatus interiorly to the box in place.

An adhesive is placed on the underside of the extended portion of the transparent plate protruding from the perimeter of the face cover plate in order that the identification label may be affixed thereto, the identification label being thereby protected from the environment by being on the underside of the transparent plate.

Accordingly, it is an object of the subject invention to provide a means located at the electrical wall outlet box to identify the electrical circuit which is supplying that outlet with electrical power.

It is another object of the subject invention to provide a visible means to identify the electrical circuit supplying an electrical wall outlet where the identification means is protected from misuse, abuse, and is always readily visible.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

BRIEF DESCRIPTION OF THE DRAWINGS

For further understanding of the nature and objects of the present invention, reference should be had to the following detailed description taken in connection with accompanying drawings wherein:

FIG. 1 is a perspective view of the circuit marking identification plate;

FIG. 2 is a perspective view of an alternate embodiment of the subject circuit marking identification plate;

FIG. 3 is an exploded perspective view of the subject invention in place intermediate the electrical wall outlet box and the electrical receptacle or switch base plate, and showing in addition the cover plate; and FIG. 4 is a perspective view of an alternate embodiment of the subject circuit marking identification plate.

In the various views, like index numbers refer to like elements.

DETAILED DESCRIPTION OF THE PREFERRED EMBODIMENT

Referring now to FIG. 1, a perspective view of the subject electrical circuit marking identification plate 10 is detailed. In the embodiment shown in FIG. 1, the identification plate is for a wall mounted electrical outlet box having four female electrical receptacle outlets, or two electrical switches, or a combination of two female electrical outlets and one electrical switch.

The preferred embodiment detailed in FIG. 1 comprises a piece of flat, relatively thin (1/16th. to ⅛th. inch) transparent plastic shaped somewhat rectangularly, being generally ½ to ¾ inch larger than the electrical wall outlet box cross-sectional size on three sides, the exception being the topmost portion of the identification plate 10 which has approximately one additional inch for receiving an identification marker label. The identification plate 10 has an opening 12 located interiorly around which the perimeter above described encompasses, and four rounded notches 14, two on the bottom and two on the top, which have been cut into the perimeters from the central opening 12. These notches 14 are adapted to allow the screw passing from the top of the electrical apparatus (electrical outlet receptacle or electrical switch) base plates into the electrical outlet box through the threaded holes 31 (FIG. 3).

On the underneath of the topmost portion of the identification plate, i.e., that portion which has a perimeter width greater than the remaining portion of the perimeter, is a layer of adhesive 16 adapted to receive the paper-type identification marker label on which is identified the particular circuits, controls, and panel members. This layer of adhesive or mucilage 16 may be sprayed or painted upon the underside of the identification plate 10 or, may be a layer of two-sided clear cellophane tape commercially available. In either case, a sticky surface is provided to receive the identification marker label. Shown in FIG. 1 is the subject invention with the identification marker label adhered to the circuit marking identification plate 10, the marker having printed on it the words as seen, "PANEL NO.:, CIRCUIT NO.:, and CONTROLS:".

Thus it is apparent that the engineer or electrician, in wishing to identify the particular panel number, circuit numbers, and controls indicia for a particular wall electrical outlet or switch, merely marks the appropriate numbers upon the label, affixes the label to the underside of the top transparent portion of the circuit marking identification plate so that the data is visible therethrough, remove the present existing face cover plate on the electrical wall outlet, loosen the receptable or switch, place the subject electrical circuit identification plate 10 over the electrical wall outlet box and under the tabs or tangs on the receptacle, so that the notches line up with the screw holes in the electrical wall outlet box, re-tighten the receptacle screws and then replace the electrical wall box face cover plate.

After the electrical wall box face cover plate is in place, a small portion of the subject electrical circuit marking identification plate 10 will appear around the face cover plate a short distance on three sides, and the information data and printing of the label showing above the electrical outlet face cover plate. In a properly placed electrical wall outlet, the subject electrical circuit identification plate 10 is flat against the wall housing the electrical wall outlet.

Referring now to FIG. 2, an alternate embodiment of the subject invention is shown, i.e., the electrical circuit marking identification plate 20 for use upon an electrical wall outlet box which only has two female electrical wall receptacles or one electrical switch. Such alternate embodiment comprises similar components as the circuit marking identification plate 10 in FIG. 1, namely the oppositely situated notches 24 to allow passage of the receptacles or switch holding screws into the electrical wall outlet box, the central opening 22 in the proximate center of the identification plate 20, and the expanded upper portion perimeter part having the mucilage or adhesive 26 affixed to its underside.

Referring now to FIG. 3, an example is shown in an exploded perspective view of the subject electrical circuit marking identification plate 10 in place affixed to an electrical wall outlet box with the cover plate separated from the electrical wall outlet. Firstly, the electrical wall outlet box 30 is shown in place with its perimeter flush with the wall and its cavity protruding into the wall. This electrical wall outlet box is in common use in homes, factories, and offices, is of standard size having a size substantially $3\frac{3}{4}$ inch$\times$3 inch$\times$2 inch. The 2 inch dimension protrudes into the wall with the open box edge of the electrical wall outlet box approximately flush with the wall. Electrical wires feed in through the back and side portions of the electrical wall outlet box 30, and the electrical wall outlet box 30 is affixed by its side to a stud in the wall to the electrical outlet receptacle 33 and electrical switch 37 located interiorly therein. Tangs 32, four of which are shown in FIG. 3, protrude perpendicularly from the sides of the electrical wall outlet box 30, the tangs having a threaded opening 31 to receive receptacle or switch holding screws 39. The tangs are so constructed that the topmost flat portion of each tang 32 is substantially in the same plane as the top open perimeter of the electrical wall outlet box 30. Spaced away from electrical wall outlet is the face cover plate 36 which has a number of openings therethrough, such as openings 38 to permit female electrical receptacles located in the electrical outlet box to protrude, as well as opening 40 for the handle of an electrical switch, which may also be located in electrical wall outlet box 30 to protrude. Screw holes 35 are formed in cover plate 36 for the shank of screws 34 to pass. The cover plate 36 is designed to be affixed next to the electrical receptacle 33 or switch 37, being held in place by screws 34 screwed into the threaded openings of electrical receptacle 33 or switch 37 base plates. Screws 34 of cover plate 36 then pass through center opening 12 of the subject invention. The electrical female receptacles 33 protrude through the openings 38 of cover plate 36, and an electrical switch 37 handle through the opening 40 of cover plate 36.

However, when applicant's transparent electrical circuit marking identification plate 10 is utilized, it is situated between the electrical receptacle 33 and electrical wall outlet box 30, adapted as shown in FIG. 3, to have its inside opening 12 just above and outside the perimeter of electrical wall outlet box 30. Notches 14 permit the entry of electrical receptacle 33 holding screws 39 into the threaded openings 31 in tangs 32 (shown in place at the bottom of electrical receptacle 33 and switch 37), however, the notches 14 ride upon the tangs 32 adjacent the threaded opening in tangs 32. In this way, the circuit marking identification plate 10 will reside flush to the wall that the electrical wall outlet box 30 resides in. Cover plate 36 then is affixed to electrical receptacle 33 and switch 37 and is on top of electrical circuit marking identification plate 10.

Thus, the change to the original configuration is to displace the face cover plate 36 away from the electrical wall outlet box 30 by the thickness of the circuit marking identification plate 10.

The purpose for the opening 12 formed in the electrical circuit marking identification plate 10 being slightly larger, in the preferred embodiment, than the outside perimeter of the electrical wall outlet box 30 is because it is common in practice for the upper perimeter surface of the electrical wall outlet box 30 to not be flat, and it has been determined that problems caused by uneven portions of the top surface may be avoided in many cases by contacting the electrical wall outlet at the tangs only, and then, as shown in the embodiment, only a portion of the tangs.

Referring now to FIG. 4, a still further alternate embodiment of the subject invention is shown where the circuit marking identification plate 50 now is adapted to engage all portions of the upper perimeter surface of the electrical wall outlet box, plate 50 having an opening 54 in its center to permit the electrical receptacle or switch to protrude. Here, holes 52 are placed in the electrical circuit marking identification plate 50 to permit the passage of the screws holding the face cover plate to the electrical receptacle or switch base plate. At the top-most portion of circuit marking identification plate 50 is cross-hatching representing the adhesive which is placed upon the underside of the plate 50.

While a preferred embodiment of applicant's apparatus has been shown and described, together with alternate embodiments, it is appreciated that still other embodiments of the invention are possible and that there is no intent to limit the invention by such disclosure, but rather it is intended to cover all modifications and still other alternate embodiments falling within the spirit and the scope of the invention as defined by the appended claims.

I claim:

1. In an electrical wall outlet box having electrical apparatus contained therein and its face cover plate, an improved electrical circuit marking identification plate for labeling adapted to be placed between the electrical wall outlet box and the face cover plate, the identification plate comprising:

a flat transparent plate having four sides and larger in size than the face cover plate, at least one of said sides extending substantially beyond the face cover plate;

a first opening in said flat transparent plate adapted to permit passage of electrical apparatus contained in the electrical wall outlet therethrough;

a second opening formed in said flat transparent plate to permit passage of screws from the face cover plate to the electrical wall outlet box; and an adhesive coating placed upon the side of the flat transparent plate extending beyond the face cover plate, said adhesive coating to receive and secure an electrical circuit identification label.

2. The electrical circuit marking identification plate as defined in claim 1 wherein said adhesive coating comprises double sided cellophane clear adhesive tape.

3. The electrical circuit marking identification plate as defined in claim 2 wherein said second opening comprises a plurality of openings formed in said flat transparent plate.

4. The electrical circuit marking identification plate as defined in claim 3 wherein said first opening and plurality of second openings are connected to each other.

5. The electrical circuit marking identification plate as defined in claim 4 wherein said first opening is larger than the opening of the electrical wall outlet box.

6. The electrical circuit marking identification plate as defined in claim 5 wherein said flat transparent plate engages tangs located on the electrical wall outlet box proximate said second plurality of openings.

7. The electrical circuit marking identification plate as defined in claim 6 wherein said first opening comprises a plurality of openings formed in said flat transparent plate.

* * * * *

UNITED STATES PATENT AND TRADEMARK OFFICE

CERTIFICATE OF CORRECTION

PATENT NO. : 4,479,317

DATED : October 30, 1984

INVENTOR(S) : Ivan E. Hanna

It is certified that error appears in the above-identified patent and that said Letters Patent are hereby corrected as shown below:

In the Abstract

Line 1, delete "making", and insert in its place --marking--.

Signed and Sealed this

*Nineteenth* Day of *March 1985*

[SEAL]

*Attest:*

DONALD J. QUIGG

*Attesting Officer* *Acting Commissioner of Patents and Trademarks*